United States Patent [19]

Ashworth

[11] 4,296,833

[45] Oct. 27, 1981

[54] HYDRAULICALLY OPERATED ACCESS EQUIPMENT

[75] Inventor: Denis H. Ashworth, Wombourne, England

[73] Assignee: Simon Engineering Dudley Limited, Dudley, England

[21] Appl. No.: 30,447

[22] Filed: Apr. 13, 1979

[51] Int. Cl.[3] ..... B66F 11/04

[52] U.S. Cl. ..... 182/2

[58] Field of Search ..... 182/2, 141, 148

[56] References Cited

U.S. PATENT DOCUMENTS

| | | | |
|---|---|---|---|
| 2,928,493 | 3/1960 | Clements | 182/2 |
| 3,072,215 | 1/1963 | Rush | 182/2 |
| 4,081,055 | 3/1978 | Johnson | 182/2 |

*Primary Examiner*—Reinaldo P. Machado
*Attorney, Agent, or Firm*—Norris & Bateman

[57] ABSTRACT

Access equipment comprising a wheeled vehicle (10) carrying on its chassis a turntable (11) on which is rotatably mounted a supporting structure (12) on which, in turn, is mounted a pair of articulated booms (14,16) having hydraulic actuating rams (20,21) and carrying a personnel platform (18) at the free end of the boom assembly, there being at each end of each boom a guide pulley or half pulley (22,23,24) around which passes a control or support line (26) anchored to the supporting structure (at 27) and to the platform (at 28), the line (26) remaining taut along a path whose length remains constant irrespective of the configuration of the boom assembly.

11 Claims, 3 Drawing Figures

HYDRAULICALLY OPERATED ACCESS EQUIPMENT

This invention concerns access equipment of the kind comprising a supporting structure upon which is mounted an articulated boom assembly comprising one or more booms, the or each boom being connected to the supporting structure or to the next adjacent boom so as to be pivotable relative thereto about a horizontal axis to enable the outermost end of the boom assembly to be raised and lowered with respect to the supporting structure and including hydraulic actuating rams for effecting movement of the boom assembly, and preferably including means such as a personnel platform or a remotely operated work tool pivotally connected to the free end of the boom assembly.

The platform, where provided, in conventional access equipment of this general kind is maintained level irrespective of the angular disposition of the boom assembly, by means of one or more rigid links which, together with the associated boom or booms, form a parallelogram linkage system. Furthermore, where it is necessary for flexible electrical or hydraulic lines to extend between the supporting structure and the outermost end of the boom assembly, these lines often sustain excessive wear at the pivotal connection or connections.

According to the present invention there is provided access equipment of the kind comprising a supporting structure upon which is mounted an articulated boom assembly comprising one or more booms, the or each boom being connected to the supporting structure or to the next adjacent boom so as to be pivotable relative thereto about a horizontal axis to enable the outermost end of the boom assembly to be raised and lowered with respect to the supporting structure, and including hydraulic actuating rams for effecting movements of the boom assembly, characterised in that a guide member is provided at each end of the or each boom, in that at least one control or support line, being flexible throughout at least a part of its length, is attached at one end to the supporting structure and extends to the outermost end of the boom assembly lying substantially parallel to the boom or booms, and passing around said guide members at the ends thereof and is secured at the said outermost end, and in that the said line is maintained taut along a path whose length remains constant irrespective of the configuration of the boom assembly.

The invention will be further apparent from the following description with reference to the accompanying drawings which show, by way of example only, one form of access equipment of the kind referred to embodying the invention. Of the drawings.

Figure 1:
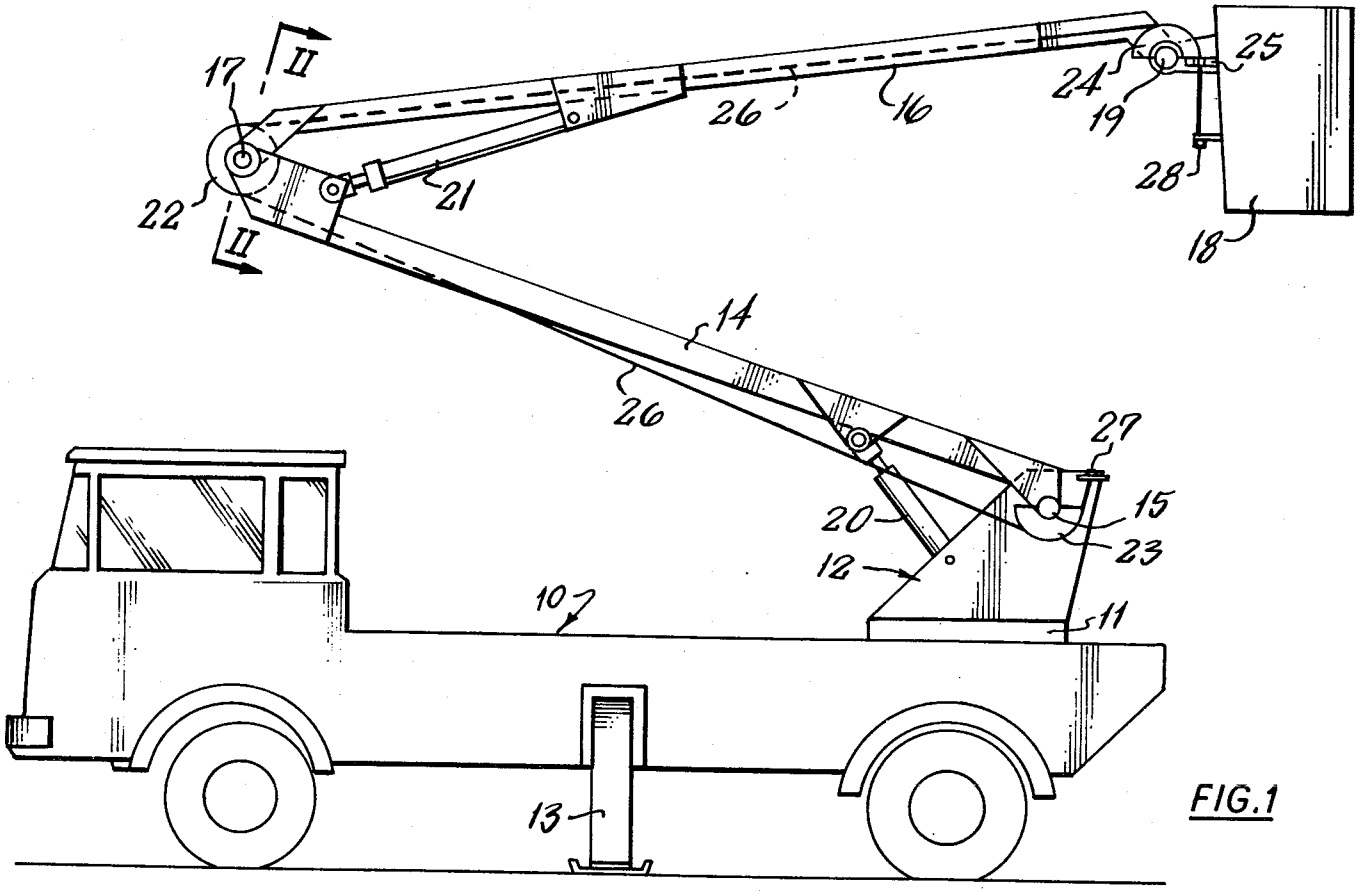
FIG. 1 shows a side elevation of the equipment.

Referring now to the drawings, it will be seen that the equipment is essentially comprised by a wheeled vehicle generally indicated at 10 which carries on its chassis a turntable 11 capable of rotation by means of for example, an hydraulic motor (not shown) and forming part of a supporting structure generally indicated at 12 for an articulated boom assembly. The vehicle 10 is equipped with hydraulically extendible and retractable ground-engaging stabilising jacks 13.

The boom assembly is comprised by a first boom 14 which is pivotally connected at 15 about a horizontal axis to the supporting structure 12, and a second boom 16 similarly connected at 17 to the free end of the first boom 14. A personnel platform or cage 18 is pivotally connected at 19 to the free end of the second boom 16.

Double-acting hydraulic rams 20 and 21 serve to adjust the angle of inclination of the booms 14 and 16 respectively. Control means (not shown) for the rams 20 and 21 are provided on the vehicle and on the platform 18 so that the boom assembly can be manipulated by an operator situated on the ground or on the platform.

In accordance with the invention, a freely rotatable pulley 22 is provided at the pivotal connection 17 of the booms 14 and 16, half-pulleys 23 and 24 being provided respectively at the pivotal connections 15 and 19. The half-pulley 23 is fixed with respect to the structure 12 about which the boom 14 is rotatable, and the half-pulley 24 is freely rotatable with respect to the boom 16 but fixed with respect to the platform 18 by means of a bracket 25.

In order to ensure that the platform 18 is maintained level irrespective of the configuration of the boom assembly, a flexible line 26, preferably a steel cable, is anchored at 27 to the supporting structure 12 and passes around half-pulley 23, pulley 22 and half-pulley 24, as guide members, to be further anchored at 28 to the platform 18. In this way, the path occupied by the line 26 is of constant length irrespective of the configuration of the boom assembly so that the platform remains level as the booms are raised and lowered, the weight of the platform serving to keep the line 26 taut. The diameters of the pulley and half-pulleys are equal so that, for example, as the boom 16 is raised the length of line 26 which leaves the circumference of pulley 22 is exactly equal to the amount laid onto the circumference of half-pulley 24. Thus the portion of line 26 between pulley 22 and half-pulley 24 undergoes a small linear movement towards half-pulley 24 as boom 16 is raised, whereas that portion between pulley 22 and half-pulley 23 remains stationary while boom 14 is stationary.

Figure 2:
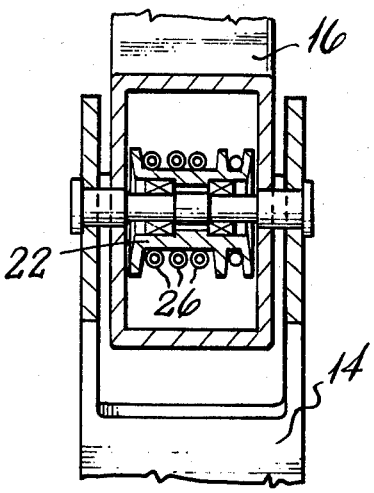
FIG. 2 is a section taken on line II—II of FIG. 1.

The line indicated at 26 in FIG. 1 can also represent one or more flexible electrical cables or hydraulic hoses connecting control means on the platform with those on the vehicle. FIG. 2 shows, as an example, three hydraulic hoses and one levelling cable passing over the pulley 22. In this example, the pulley is formed with a separate annular channel for the levelling cable so as to prevent the latter from physical contact with the hoses and thus avoiding any possibility of damage thereto. The arrangement of pulleys and half-pulleys just described ensures that the hoses and/or cables are subjected to the minimum of wear during movement of the boom assembly.

The linear portions of cable or hose extending along each boom can be formed as rigid rods or pipes which are connected to their corresponding linear portions on the other boom and to the anchor points 25 and 27 by flexible portions which pass around the pulley and half-pulleys. The rigid rods or pipes are thus supported in sliding means which permit free linear movement during angular movement of the booms.

It will be appreciated that there may be more than two articulated booms making up the boom assembly and any one or more of the articulated booms may be telescopically extendible.

Figure 3:
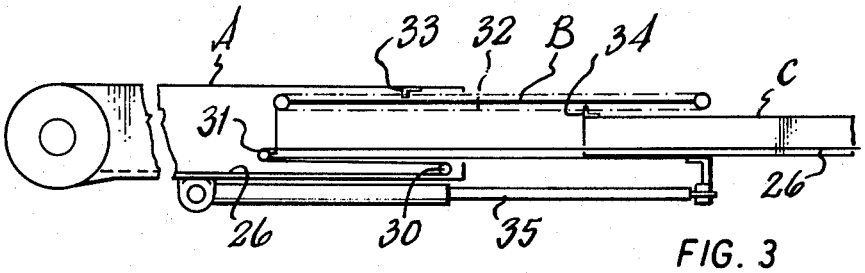
FIG. 3 is a schematic fragmentary view of a telescopically extendible boom being part of a boom assembly.

FIG. 3 illustrates an arrangement enabling the line 26 to be carried through a telescopically extendible boom arrangement by passing around a first pulley 30 and a second pulley 31. The boom consists of a first section A, a second or intermediate section B, and a third or final section C. The intermediate section B carries a chain 32 which is connected at 33 to section A and at 34 to section C. A double-acting hydraulic ram 35 is connected between sections A and B, which when extended causes section C to move twice the distance that section B moves. The pulleys 30 and 31 wrapped by the line 26 are thus arranged with respect to the boom sections A and B such that the line 26 moves simultaneously with and through the same distance as section C. Pulleys 30 and 31 can be made to accommodate any number of lines 26 arranged in a parallel relationship one with another.

It is not intended to limit the invention to the above example only, many variations, such as might readily occur to one skilled in the art, being possible without departing from the scope of the In the arrangement illustrated in FIG. 1, the weight of the platform 18 maintains the line 26, where it represents the support cable, in a taut condition. Thus the platform would be free to rise in the event that it were to collide with a fixed object as the boom assembly is lowered.

If it is required to ensure that the platform 18 cannot deviate from a level condition it is conceived that a further support line could extend from an anchor position adjacent the top of the platform to pass around the lower side of a complete pulley replacing half-pulley 24, and extend to the pulley 22, passing around the lower side of the latter and emerging from the upper side, and extending towards a complete pulley replacing half-pulley 23, to extend around the upper side of the latter, and finally to be anchored somewhere adjacent the base of the supporting structure 12. This further line would then act in the reverse manner to line 26 and together with same, would prevent the platform 18 from any free rotation.

I claim:

1. Access equipment of the kind comprising a supporting structure upon which is mounted an articulated boom assembly comprisng one or more booms, the or each boom being connected to the supporting structure or to the next adjacent boom so as to be pivotable relative thereto about a horizontal axis to enable the outermost end of the boom assembly to be raised and lowered with respect to the supporting structure, and including hydraulic actuating rams for effecting movements of the boom assembly, characterised in that a guide member is provided at each end of the or each boom, in that at least one support line, being flexible throughout at least a part of its length, is attached at one end to the supporting structure and extends to dispose its other end at the outermost end of the boom assembly, lying substantially parallel to the boom or booms, and passing around said guide members at the ends thereof and is secured at the said outermost end, in that the said support line is maintained taut along a path whose length remains constant irrespective of the configuration of the boom assembly, and in that one or more flexible control lines are arrayed parallel with said support line, from said supporting structure, around said guide members and to the outermost end of said boom assembly, whereby said one or more control lines are retained taut and in close association with said support line in all phases of articulation of said boom to thus minimize wear of said one or more control lines caused by boom movement.

2. Access equipment according to claim 1, including means such as a personnel platform or a remotely operated work tool, pivotally connected to the free end of the boom assembly, said support line at the outermost end of the boom assembly being anchored in fixed relationship with said means.

3. Access equipment according to claim 1, or claim 2, wherein said means is a personnel platform and said support line serves as a support cable fixed to the platform to maintain the platform level for all configurations of the boom assembly, the weight of the platform maintaining the cable taut.

4. Access equipment according to claim 1, wherein said one or more control lines comprises one or more hoses arrange to carry fluids to or from the said outermost end of the boom assembly.

5. Access equipment according to claim 1, wherein said control line comprises a support cable and said one or more control lines comprises one or more fluid-carrying hoses.

6. Access equipment according to claim 1, wherein each said guide member consists of a pulley or half-pulley so connected to its associated boom end that the latter is freely rotatable relative thereto.

7. Access equipment according to claim 1, wherein a linear portion of the support line is formed as a rigid rod or pipe supported with respect to its associated boom for sliding linear movement relative thereto upon pivotal movement thereof.

8. Access equipment according to claim 1, wherein the boom or at least one of the booms of the boom assembly is telescopically extendible, said support and said one or more control lines being accommodated therein by passing around a plurality of pulleys attached thereto.

9. Access equipment according to claim 1 wherein the supporting structure and the boom assembly mounted thereon are rotatably mounted about a vertical axis on a turntable, the turntable being mounted on the chassis of a wheeled vehicle.

10. Access equipment of the kind comprising a supporting structure upon which is mounted an articulated boom assembly comprising a first boom pivotally connected to the supporting structure and a second boom pivoted to the first boom, a platform or like member pivotally connected to the outermost end of said second boom and means enabling the outermost end of the boom assembly to be raised and lowered with respect to the supporting structure including hydraulic actuating means for effecting relative movement of the booms and movement of the boom assembly; characterized in that a fixed guide member is mounted on said supporting structure, a freely rotatable guide member is provided at the pivotal connection between the booms and a guide member fixed with respect to said platform member is rotatively connected to the outermost end of the second boom, a platform attached support line that is flexible throughout at least a part of its length is attached at one end to said supporting structure and extends to the outermost end of the boom assembly where it is connected to said platform member, said line being substantially parallel to said booms over its length and passing around all of said guide members, said guide members being so constructed and arranged and said line being so associated therewith that said line is maintained taut along a path whose length remains constant irrespective of the configuration of the boom assembly, and one or more control lines are provided and arrayed parallel with said support line, from said supporting structure around said guide members and to said platform or like member, whereby said one or more control lines are retained taut and in close association with said support line in all phases of articulation of said boom to thus minimize wear of said one or more control lines caused by boom movement.

11. The access equipment defined in claim 10, wherein said freely rotatable guide member is a pulley, and said fixed guide members are at least partially shaped as pulleys.

* * * * *